US011541973B1

(12) United States Patent
Hellesmark

(10) Patent No.: US 11,541,973 B1
(45) Date of Patent: Jan. 3, 2023

(54) FLOATING STORAGE VESSEL WITH EXTENSION SECTIONS AND OFFSHORE TERMINAL

(71) Applicant: Stena Power & LNG Solutions AS, Grimstad (NO)

(72) Inventor: Svein Børge Hellesmark, Fevik (NO)

(73) Assignee: Stena Power & LNG Solutions AS, Grimstad (NO)

( * ) Notice: Subject to any disclaimer, the term of this patent is extended or adjusted under 35 U.S.C. 154(b) by 0 days.

(21) Appl. No.: 17/704,421

(22) Filed: Mar. 25, 2022

(51) Int. Cl.
*B63B 35/44* (2006.01)
*B63B 21/50* (2006.01)
*B63B 27/34* (2006.01)

(52) U.S. Cl.
CPC ..... *B63B 35/44* (2013.01); *B63B 21/50* (2013.01); *B63B 27/34* (2013.01); *B63B 2035/4486* (2013.01)

(58) Field of Classification Search
CPC ..... B63B 35/44; B63B 21/50; B63B 27/34; B63B 2035/4486
See application file for complete search history.

(56) References Cited

U.S. PATENT DOCUMENTS 3,715,890 A 2/1973 Langner
3,931,782 A * 1/1976 Childers ..... B63B 21/22 114/294
8,100,076 B1 * 1/2012 Shivers, III ..... B63B 27/30 114/230.17
8,250,883 B2 8/2012 Migliore et al.
8,286,678 B2 10/2012 Adkins et al.
8,490,562 B1 * 7/2013 Shivers, III ..... B63B 27/30 114/230.17
2003/0061980 A1 * 4/2003 Cottrell ..... B63B 27/24 114/293
2004/0099337 A1 5/2004 Hilden et al.
2009/0266087 A1 10/2009 Adkins et al.
2012/0049622 A1 3/2012 Young et al.
2012/0230772 A1 9/2012 Foo et al.
2013/0333397 A1 12/2013 Moon et al.
2014/0251493 A1 9/2014 Foo et al.
2016/0231050 A1 8/2016 Faka
2017/0253302 A1 9/2017 Hellesmark et al.
2019/0152569 A1 * 5/2019 Vandenworm ..... B63B 22/021
2019/0161146 A1 * 5/2019 Hellesmark ..... B63B 22/021

FOREIGN PATENT DOCUMENTS

KR 20140119997 10/2014
OA 11308 10/2003
WO WO-03013948 A2 * 2/2003 ..... B63B 21/50

* cited by examiner

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

Offshore terminal apparatus which in various examples comprises a floating storage vessel which is spread-moored in fixed heading orientation to a seabed offshore by spread mooring lines, the floating storage vessel comprising a hull having bow and stern ends and which at either or both the bow end and the stern end is fitted with an extension section and includes coupling means on the extension section to couple spread mooring lines to the floating storage vessel.

30 Claims, 6 Drawing Sheets

FLOATING STORAGE VESSEL WITH EXTENSION SECTIONS AND OFFSHORE TERMINAL

FIELD

The present invention relates to spread-moored floating storage vessels, and offshore terminal apparatuses in which a cargo vessel is moored to the spread-moored floating storage vessel for offshore loading or offloading of fluid cargo.

BACKGROUND

Floating storage vessels may be employed for storing fluid products in large quantities at offshore locations. The floating storage vessel can be permanently moored at an offshore location and visited from time to time by a cargo vessel for loading or offloading. Examples of floating storage vessels of this kind includes those termed in the art as a floating storage unit (FSU), a floating storage and regasification unit (FSRU), and/or the like.

FSUs today are typically converted previously-in-service tanker vessels. Conversion of an existing previously-in-service tanker to a floating storage unit is the typical preferred option in the industry seen from a technical, schedule and commercial point of view.

U.S. patent application publication number US2019/0161146 describes a jetty-less offshore terminal in which a floating storage unit (FSU), is spread-moored to the seabed offshore. In one example, the offshore terminal includes a jack-up platform with equipment for regasification on one side of the floating storage unit. A cargo vessel is from time-to-time moored side-by-side to the other side of floating storage unit for ship-to-ship offloading fluid cargo from the cargo vessel onto the FSU. The side-by-side mooring allows a hose tor transferring the fluid cargo to be connected between the cargo vessel and the FSU without a dedicated utility unit to carry the hose across sea to the cargo vessel.

For large cargo vessels, tug assistance may typically be needed to help to control the movement of the cargo vessel sideward toward the floating storage vessel for side-by-side mooring. Mooring lines for mooring the cargo vessel to the floating storage vessel are passed between the cargo vessel and the floating storage vessel and tensioned.

Bringing a large cargo vessel alongside a floating storage vessel that is moored in fixed heading orientation by spread-mooring lines, can be especially challenging when doing so under adverse met-ocean conditions. For example, it can be challenging to control the movement of the cargo vessel and the assisting tugs and to provide the necessary fine control to bring the cargo vessel safely into correct mooring position alongside the floating storage vessel.

SUMMARY

In examples disclosed herein, there is provided a floating storage vessel comprising a hull having bow and stern ends and which at either or both the bow and stern ends is fitted with an extension section and includes coupling means on the extension section to couple spread mooring lines to the floating storage vessel.

Typically, the hull comprises a hull deck at a top of the hull, and the extension section is arranged to be aligned in elevation with the hull deck. The extension section may comprise a box structure comprising an extension section deck which is arranged at or near the level of the hull deck.

Typically, the extension section comprises a box structure of welded plates. The extension section deck is provided on or incorporated into the structure of welded plates. The coupling means may be arranged on or be accessible by personnel from the extension section deck.

In certain examples, the extension section comprises a box structure which extends from a first end to a second end in a horizontal direction, the first end of the box structure connecting to the hull at an upper location on the bow or stern end, wherein the box structure may be supported by at least one bracing member connecting to the box structure at a location between the first and second ends of the box structure, or at the second end of the box structure, and to the hull at a lower location on the bow or stern end, the lower location for example being near a propeller location if disposed on the stern or near a bulb location if disposed on the bow.

In certain examples, the extension section comprises a box structure comprising welded steel plates, wherein the structure is elongate to extend between first and second ends, the extension section being welded at the first end to join the box structure to the hull, without requiring further connections of the box structure to the hull or other supporting parts for providing the extension section in operational configuration at the bow or stern end of the hull.

Typically, the extension section has first and second ends and extends in a horizontal extension direction between the first and second ends, the first end being weldably joined to the hull for fitting the extension section onto the hull, the second end arranged distally from the joined first end.

The extension section at either or both the bow and stern ends is may be deviated extension section, and the extension section deviates at an angle from a longitudinal axis of the hull.

The spread mooring line may be or may comprise a spread mooring chain.

In examples disclosed herein, there is provided offshore terminal apparatus comprising: a floating storage vessel which is spread-moored in fixed heading orientation to a seabed offshore by spread mooring lines, the floating storage vessel comprising a hull having bow and stern ends and which at either or both the bow end and the stern end is fitted with an extension section and includes coupling means on the extension section to couple spread mooring lines to the floating storage vessel.

A mooring area for mooring a cargo vessel to the floating storage vessel may be provided in a defined region alongside the floating storage vessel between the bow end and stern end spread-mooring lines, so that mooring of the cargo vessel alongside the floating storage vessel can be facilitated without the hull of the cargo vessel coming into overlap or interfering with the spread-mooring lines.

In some examples, the floating storage vessel comprises bow and stern extension sections, and the cargo vessel is moored in a mooring area alongside the floating storage vessel between the extension sections, the coupling means on the extension sections defining points of departure for the spread mooring lines from the floating storage vessel, so that at least a predetermined distance or gap is maintained in a horizontal direction between the spread mooring lines and the moored cargo vessel, e.g. the nearest point thereof at the bow or stern of the cargo vessel.

By way of the extension section(s), the mooring area can be provided such that large cargo vessels can be moored alongside the floating storage unit with safety gap between the cargo vessel and the spread mooring lines of the floating storage unit. The provided mooring area can so provide accessibility for tugs for assisting with mooring the cargo vessel close to the floating storage vessel and facilitate safe movement and control of the cargo vessel upon bringing the cargo vessel adjacent to the side of the floating storage vessel. The tugs may be connected to and arranged with respect to the vessel with further options for tug line configuration and tug contact points against the cargo vessel such that finer control and adjustment of the movement of the cargo vessel when being brought alongside the floating storage vessel may be possible.

The cargo vessel may be brought into position and moored while coping more easily with challenging met-ocean conditions. The terminal can therefore be provided so that the floating storage vessel in the form of a previously-in-service tanker as typically of length 250 to 300 m, and converted to be fitted with the extension section, and the cargo vessel in the form of an in-service tanker ship, e.g. of the same type, length and capacity as the floating storage vessel before being converted.

The match or similarity in size between the cargo vessel and floating storage vessel can be beneficial for optimizing operations. Thus, advantageously the length of the cargo vessel may be equal to, or typically less than 5% different to the length of the hull of the floating storage vessel. However, the cargo vessel may be of any length, and configuration otherwise to allow mooring alongside. In certain variants, the length of the cargo vessel may be less than 5% to 50% different in length to the length of the hull of the floating storage vessel. The length of the hull of the floating storage vessel may be the length of the pre-converted hull to which the extension sections in embodiments of the invention are added. The cargo vessel may be longer or shorter than the floating storage vessel and/or longer or shorter than the pre-converted hull.

Typically, the offshore terminal apparatus further comprises the cargo vessel, the cargo vessel being moored to the floating storage vessel in side-by-side relationship for transferring fluid cargo between the cargo vessel and the floating storage vessel. The cargo vessel is moored in the mooring area between the bow end and stern end spread mooring lines. Side-by-side mooring can allow cargo transfer with relatively short cargo transfer hoses between the cargo vessel and the floating storage vessel, lower pressure losses when transferring fluid through the hoses, and consequently higher transfer capacity, whilst the cargo vessel may be brought alongside more efficiently or in adverse weather using the mooring with the extension sections. The terminal may thus offer improvements such as increased uptime, more efficient utilization of cargo transfer availability windows, and less time to complete cargo transfers.

Typically, the offshore terminal apparatus further comprises first tubing for transferring fluid cargo between the cargo vessel and the floating storage vessel. The cargo vessel is typically moored so that the mid-ship manifold of the cargo vessel is located opposite the mid-ship manifold of the floating storage vessel. The first tubing, which typically comprises one or more hoses, may thus extend between the mid-ship manifold of the respective cargo vessel and the mid-ship manifold of the floating storage vessel.

Typically, the offshore terminal apparatus further includes a platform or a transfer tower supported upon the seabed, and second tubing for transferring fluid cargo or gas between the floating storage vessel and the platform or transfer tower.

Optionally, the platform may comprise a regasification facility for regasifying offloaded fluid. The apparatus may then include third tubing for communicating the regasified fluid from the platform to shore. The third tubing may comprise a subsea pipeline, e.g. at the seabed.

Alternatively, the platform may comprise a liquefaction facility for liquefying fluid to be stored on the floating storage unit and transferred to the cargo vessel. The apparatus may then include third tubing, which may comprise a subsea pipeline, for communicating the gas to the platform.

Preferably, the platform or transfer tower is arranged on an opposite side of the floating storage vessel to the cargo vessel. The platform may conveniently be a jack-up platform, comprising legs arranged to be supported upon the seabed, and a hull that is jacked up along the legs to be positioned above the wave zone above the sea surface.

Since the regasification or liquification facility may be disposed upon the platform or support structure, such facilities, and other facilities such as cranes or lifting arms for connecting the second tubing etc., may not be required on the floating storage vessel, and the floating storage vessel used for the terminal can therefore conveniently be provided without need for extensive modifications, and help limit the time needed to install and assemble the terminal.

Typically, the hull of the floating storage vessel is modified from an original hull by adding the extension section, which may typically be a pre-fabricated unit, onto the bow end or stern end. The extension section may comprise a cantilever projecting from the original bow or stern end. The extension section may be of length sufficient to position the point of coupling of the spread mooring chains on the extension section beyond the original bow or stern end, so that the cargo vessel of preferably the same size or possible slightly longer than the original, i.e. pre-modified, floating storage vessel, can be safely moored alongside between the bow and stern end spread-mooring chains and without the hull of the cargo vessel or tugs interfering or overlapping horizontally with the spread-mooring lines extending laterally from the floating storage vessel.

Preferably, the spread mooring lines are provided in catenary configuration. In the catenary configuration, one end of the spread mooring line is connected to the coupling means at a location as high as possible above sea surface, e.g. at or near deck level, of the floating storage vessel and/or extension section, and the other end of the spread mooring line is connected to mooring member underwater on the seabed.

Preferably, the offshore terminal is a shallow water offshore terminal. The floating storage vessel may be spread moored in shallow water which has a water depth in the range of up to 50 m. The system can therefore be used for offloading fluid cargo in suitable near-shore shallow water locations, and fluid may be transported to shore through a relatively short subsea pipeline.

Using spread mooring lines which are deck mounted or otherwise mounted as high as possible above the sea to the floating storage vessel, i.e. not keel mounted, may be preferable in order to obtain an acceptable catenary shape of the mooring lines in the catenary configuration. The catenary shape in the spread mooring lines may allow dynamic vessel motions of the floating storage vessel in heavy wave conditions with acceptable mooring line forces.

The spread mooring lines, e.g. spread mooring chains, at the bow end extend at a first spread angle away from the floating storage unit with respect to the longitudinal axis of the floating storage vessel. The spread mooring lines, e.g. spread mooring chains, at the stern end extend at second spread angle away from floating storage vessel with respect to the longitudinal axis of the floating storage vessel.

The fluid cargo may be any fluid cargo for example any one or more of: liquid; gas; mixtures of liquid and gas; liquefied natural gas (LNG); liquefied petroleum gas (LPG); liquefied ammonia; liquefied hydrogen; liquefied carbon dioxide (CO2); or similar.

In examples disclosed herein, there is provided a method of using the offshore terminal apparatus, the method comprising: spread mooring a floating storage vessel in fixed heading orientation to a seabed offshore by spread mooring lines, the floating storage vessel comprising a hull having bow and stern ends and which at either or both the bow end and the stern end is fitted with an extension section and includes coupling means on the extension section to couple spread mooring lines to the floating storage vessel, and offloading fluid cargo from the cargo vessel to the floating storage vessel.

In certain examples, the method may further comprise transferring offloaded fluid cargo from the floating storage vessel to shore by use of a transfer tower.

In certain other examples, the method may further comprise any one or more of: communicating the offloaded fluid cargo from the floating storage vessel to one or more platforms; performing on the one or more platforms any of: processing the fluid cargo, the fluid cargo comprising liquefied gas; regasifying the liquefied gas to produce regasified gas; generating power using the regasified gas; generating water using the generated power; and communicating or transferring the regasified gas or generated power or generated water to shore or to another facility.

In examples disclosed herein, there is provided a method of using the offshore terminal apparatus, the method comprising: spread mooring a floating storage vessel which is spread-moored in fixed heading orientation to a seabed offshore by spread mooring lines, the floating storage vessel comprising a hull having bow and stern ends and which at either or both the bow end and the stern end is fitted with an extension section and includes coupling means on the extension section to couple spread mooring lines to the floating storage vessel, and loading fluid cargo onto the cargo vessel from the floating storage vessel.

In certain examples, the method may further comprise transferring fluid cargo from shore to the floating storage vessel.

In certain examples, the terminal apparatus may include at least one platform and the method may include exporting gas from shore to the platform, processing the gas on the platform, liquefying the gas, and transferring the liquefied gas to the floating storage vessel from the platform, the fluid cargo to be loaded comprising an amount of liquefied gas.

In examples disclosed herein, there is provided an extension section for a floating storage vessel comprising a hull comprising one or more holds or tanks in the hull for storing fluid, the hull comprising a longitudinal axis and extending longitudinally between a bow end and a stern end, the extension section comprising: a structure which extends between a first end and a second end, the first end of the structure being configured to be affixed to the stern end or the bow end of the hull with the second end being arranged distally from the stern or bow end; and coupling means supported on the structure for coupling spread mooring lines to the extension section.

Typically, the structure comprises or consists essentially of welded steel plates.

Typically, the structure comprises or is an elongated box structure.

Typically, the first end of the structure is weldable to the bow or stern end of the hull to join the structure to the hull. The structure may be configured to be sufficiently supported for operational use through only the join of the first end of the box structure.

Typically, wherein the structure has a deck for personnel access to the coupling means, the coupling means being supported on the deck.

Typically, the hull comprises a hull deck, and the structure is configured to be connected to the hull, the structure being aligned elevationally with the hull deck.

Typically, the structure extends from the first end to the second end longitudinally with respect to the hull. Alternatively, the structure extends from the first end to the second end in direction deviating at an angle from the longitudinal axis of the hull. The structure may comprise curve or dog leg section between the first and second ends of the structure so that the structure along the curve or dog leg section extends away from the longitudinal direction of the hull.

In examples disclosed herein, there is provided a method of providing a spread moored floating storage vessel for facilitating in operations of loading or offloading of fluid cargo in an offshore terminal, the method comprising: providing a tanker ship comprising one or more tanks or holds for storing fluid, and comprising a hull extending between bow and stern ends, the tanker ship desired to be converted in a conversion process into a floating storage vessel for spread-mooring in fixed heading orientation in an offshore terminal; prefabricating at least one extension section, the extension section comprising a structure which extends between a first end and a second end, and coupling means which are supported on the structure for coupling spread mooring lines to the extension section; connecting the first end of the prefabricated structure to the bow end or the stern end of the hull, affixing the extension section to the hull, the second end of the structure being arranged distally from the stern end or the bow end; and obtaining a floating storage vessel with the at least one extension section fitted thereto, spread-mooring the floating storage vessel to seabed mooring members, using the coupling means on the extension section to couple the spread mooring lines to the extension section. The method may further comprise: prior to conversion, operating the tanker ship to transport fluid cargo across sea from one location to another; after conversion, operating the floating storage vessel in the offshore terminal to store fluid to be loaded onto the cargo vessel or store fluid which is offloaded from the cargo vessel.

Embodiments of the invention may be advantageous in various ways as will be apparent herein throughout.

BRIEF DESCRIPTION OF THE DRAWINGS

There will now be described, by way of example only, embodiments of the invention, with reference to the accompanying drawings, in which.

DETAILED DESCRIPTION

Figure 1:
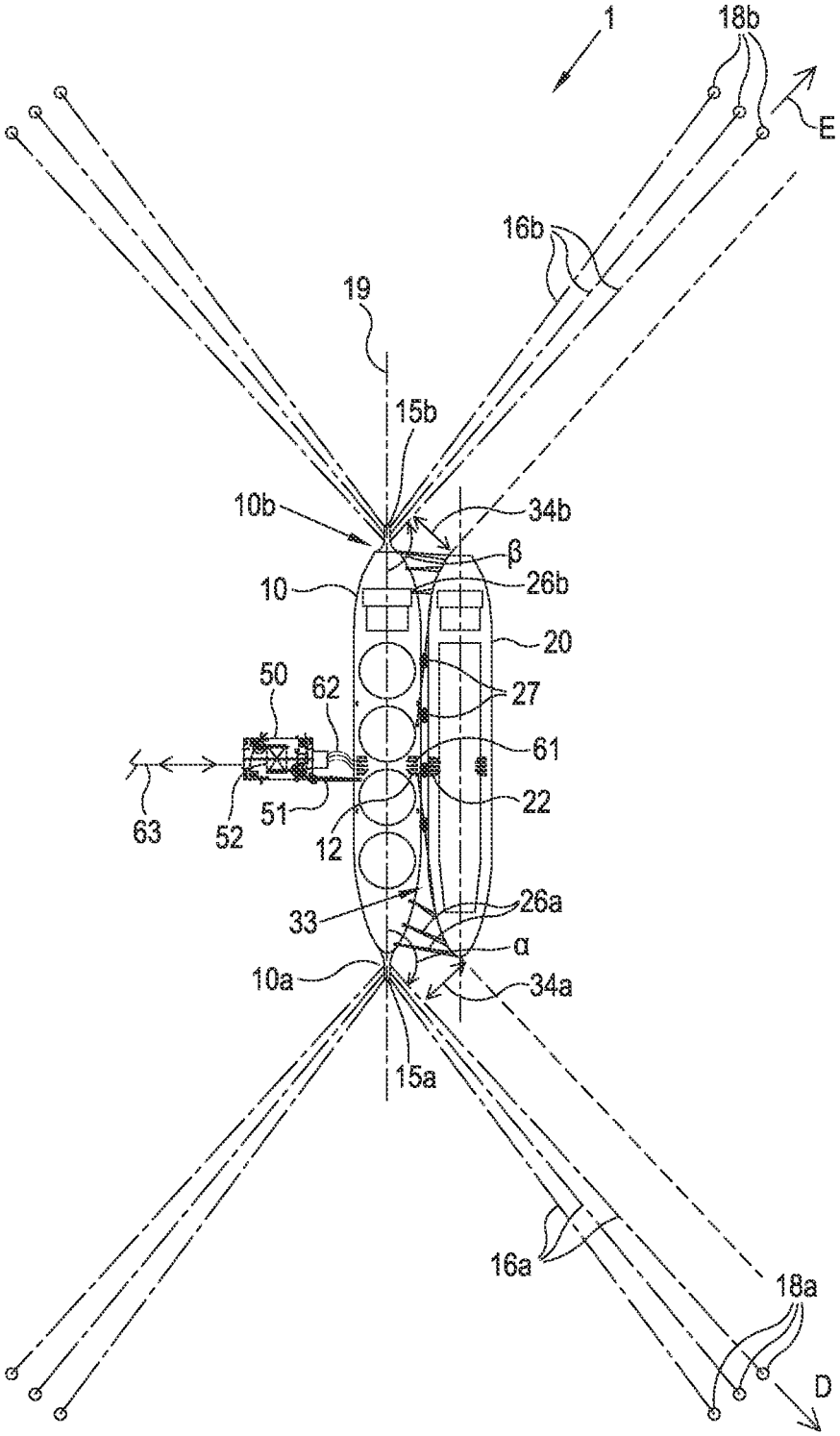
FIG. 1 is a plan-view representation of offshore terminal apparatus in which a cargo vessel is moored in side-by-side relationship to the floating storage vessel in accordance with one example.
Figure 2:
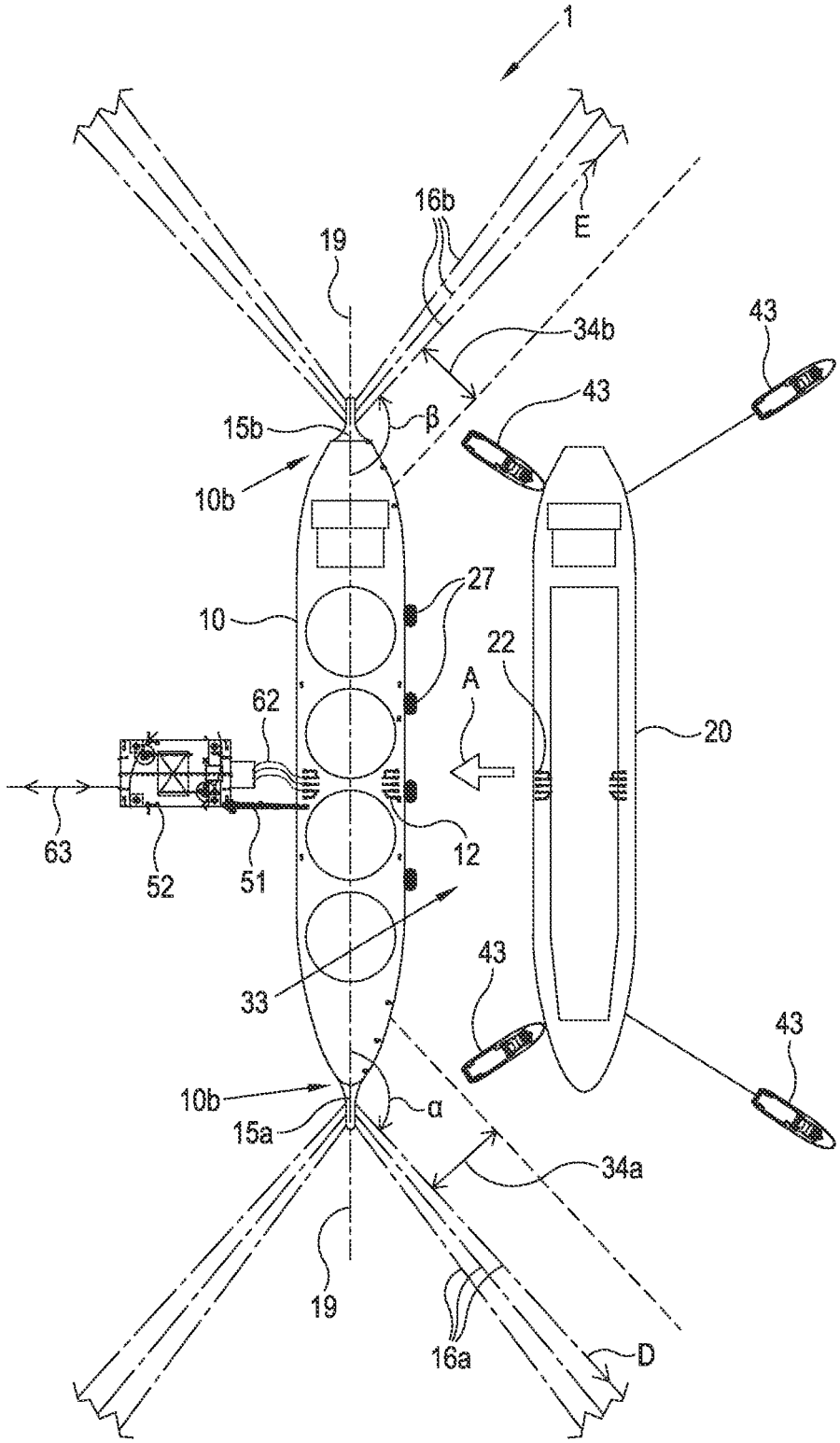
FIG. 2 is a plan-view representation showing the cargo vessel being brought alongside the floating storage vessel for mooring the cargo vessel to the floating vessel as depicted in FIG. 1.

With reference to FIGS. 1 and 2, offshore terminal apparatus 1 includes a floating storage vessel 10 which is spread-moored to the seabed offshore. At the bow end 10*a*, the floating storage vessel 10 is fitted with a first extension section 15*a*, and at the stern end 10*b*, the floating storage vessel 10 is fitted with a second extension section 15*b*. Coupling means are provided on each of the extension sections 15*a*, 15*b* to couple spread mooring lines 16*a*, 16*b* to the extension sections 15*a*, 15*b* respectively.

The storage vessel 10 is spread-moored by means of spread mooring lines 16*a*, 16*b* in fixed heading orientation with respect to the seabed. The bow end spread-mooring lines 16*a* extend from the bow end extension section 15*a* to mooring members 18*a* on the seabed. The stern end spread mooring lines 16*b* extend from the stern end extension section 15*b* to mooring members 18*b* on the seabed. Each spread mooring line 16*a*, 16*b* has a first end which is connected to coupling means 86*a*, 86*b* on the extension section 15*a*, 15*b* and a second end which is connected to the mooring member 18*a*, 18*b*. The first end of the spread-mooring line 16*a*, 16*b* is connected to the extension section 15*a*, 15*b* above sea level, typically at or near a deck level of the hull of the floating storage vessel or the extension section. The second end of the spread mooring line 16*a*, 16*b* connects underwater to the seabed mooring member 18*a*, 18*b* at or near the seabed. The spread mooring lines 16*a*, 16*b* therefore penetrate the water surface on their trajectory from the extension section 15*a*, 15*b* toward the seabed mooring member 18*a*, 18*b*.

The spread-mooring lines 16*a* extend away from the floating storage vessel 10 in a direction D forming a spread angle $\alpha$ with respect to a longitudinal axis 19 of the floating storage vessel. The spread-mooring lines 16*b* extend away from the floating storage vessel 10 in a direction E forming a spread angle $\beta$ with respect to the longitudinal axis 19 of the floating storage vessel 10, in the opposite sense to the spread angle $\alpha$.

A mooring area 33 is defined alongside the floating storage vessel between the bow end spread mooring line 16*a*, and the stern end spread mooring line 16*b*.

In FIG. 1, a cargo vessel 20 is moored in the safe mooring area 33 alongside the floating storage vessel in parallel side-by-side configuration. The cargo vessel 20 is moored via mooring lines 26*a*, 26*b* at bow and stern ends to the floating storage vessel 10. The cargo vessel 20 bears against the floating storage vessel on soft fenders 27 located between the facing hull sides of the floating storage vessel 10 and the cargo vessel 20.

In FIG. 2, the cargo vessel 20 is approaching the floating storage vessel 10, moving sideward as indicated by arrow A toward the safe mooring area 33. The cargo vessel 20 is moved using its thrusters, and further assisted by tugs 43 some pushing and some pulling to control the speed and position of the cargo vessel 20.

By virtue of the extension sections 15*a*, 15*b*, the mooring lines 16*a*, 16*b* are positioned away from cargo vessel 20. Safety gaps 34*a*, 34*b* are established between the hull of the moored cargo vessel 20 and the nearest mooring line 16*a*, 16*b* at each end of the mooring. Preferably, the extension sections are provided so that the defined safety gap provides clearance of at least 20 m between the mooring lines 16*a*, 16*b* to the cargo vessel when moored. The hull of the cargo vessel 20 is typically of the same or similar length as that of the floating storage vessel 10 before fitted with the extension sections 15*a*, 15*b*. The mooring area 33 can allow cargo vessels 20 of the same or somewhat larger size than the floating storage vessel to be brought alongside more easily and/or under control in adverse conditions. Tugs 43 which may be required to assist the cargo vessel 20 can be operated at more favorable positions relative to the cargo vessel and may operate in an operating area between bow end and stern end spread mooring lines while maintaining a predefined clearance distance to the nearest mooring line, e.g. the same distance as the safety gap. The tugs can operate in the mooring area 33 before the cargo vessel has fully arrived alongside the floating storage vessel. The spread-moored configuration can therefore be viable for side-to-side transfer of fluid cargo from large tanker ships. Cargo vessels 20, e.g. tankers, for fluid cargo transport and offloading or loading at offshore fluid transfer terminals are typically available "off the shelf" as part of the world fleet, but they are typically of similar size, and variation is limited. When the floating storage vessel 10 is also of the same kind, i.e. an out of service cargo vessel, frequently situations may occur in prior art where the available cargo vessels are unsuited for side-by-side mooring alongside the floating storage vessel. The solution of providing the extension sections 15*a*, 15*b* allows spread mooring of the floating storage vessel with greater freedom for safe maneuvering the cargo vessel 20 alongside the floating storage vessel. The cargo vessel 20 can be brought alongside and moored without transgressing the safety gap 34*a*, 34*b* toward the spread mooring chains. By fitting the floating storage vessel 10 with extension sections 15*a*, 15*b* one may conveniently provide suitable safety gaps in the terminal tailored to specific project requirements and size of the cargo vessels 20, also with due account taken of likely met-ocean conditions.

Still referring to FIGS. 1 and 2, the offshore terminal apparatus 1 additionally has a seabed-supported platform, in this example a jack-up platform 50 comprising a processing facility 52 for processing the fluid cargo. The platform 50 is arranged in an area between the bow end and stern end spread mooring chains on the other side of the floating storage vessel. The processing facility 52 for purposes of this example is a regasification facility for regasifying gas from the floating storage vessel offloaded from the cargo vessel. In other variants, the processing facility 52 may be a combined regasification and power generation facility that also may include system for freshwater generation. Alternatively, the platform may be liquefaction facility for liquefying gas to be stored the floating storage facility to be loaded onto the cargo vessel. The jack-up platform 50 has legs which are supported on the seabed, and a hull which is jacked up along the jack-up legs to a position above the sea surface clear of the wave zone. A personnel bridge 51, crossing the sea above the sea surface, extends between the platform 50 and the floating storage vessel 10.

In use, fluid cargo in the form of liquefied gas is offloaded from the cargo vessel 20 to the floating storage vessel 30 through first tubing in the form of one or more aerial hoses 61 or other loading apparatus which connect between the mid-ship manifolds 12, 22 of the floating storage vessel 10 and cargo vessel 20. The offloaded liquefied gas is stored in the floating storage vessel 30. The liquefied gas is conveyed through second tubing in the form of one or more aerial hoses to the platform 50 and is regasified by the regasification facility. The regasified gas is then transmitted away from the platform 50, typically to shore via a gas pipeline 63.

In variants in which the processing facility on the platform 50 is a liquefaction facility, in use, gas is transmitted typically from shore via gas pipeline 63 to the platform. The gas is liquefied by the liquefaction facility and then conveyed through the second tubing hoses 62 to the floating storage vessel 10 where the liquefied gas is stored. The liquefied gas is loaded onto the cargo vessel 20 from the floating storage vessel 10 through the first tubing hoses 61.

Figure 3:
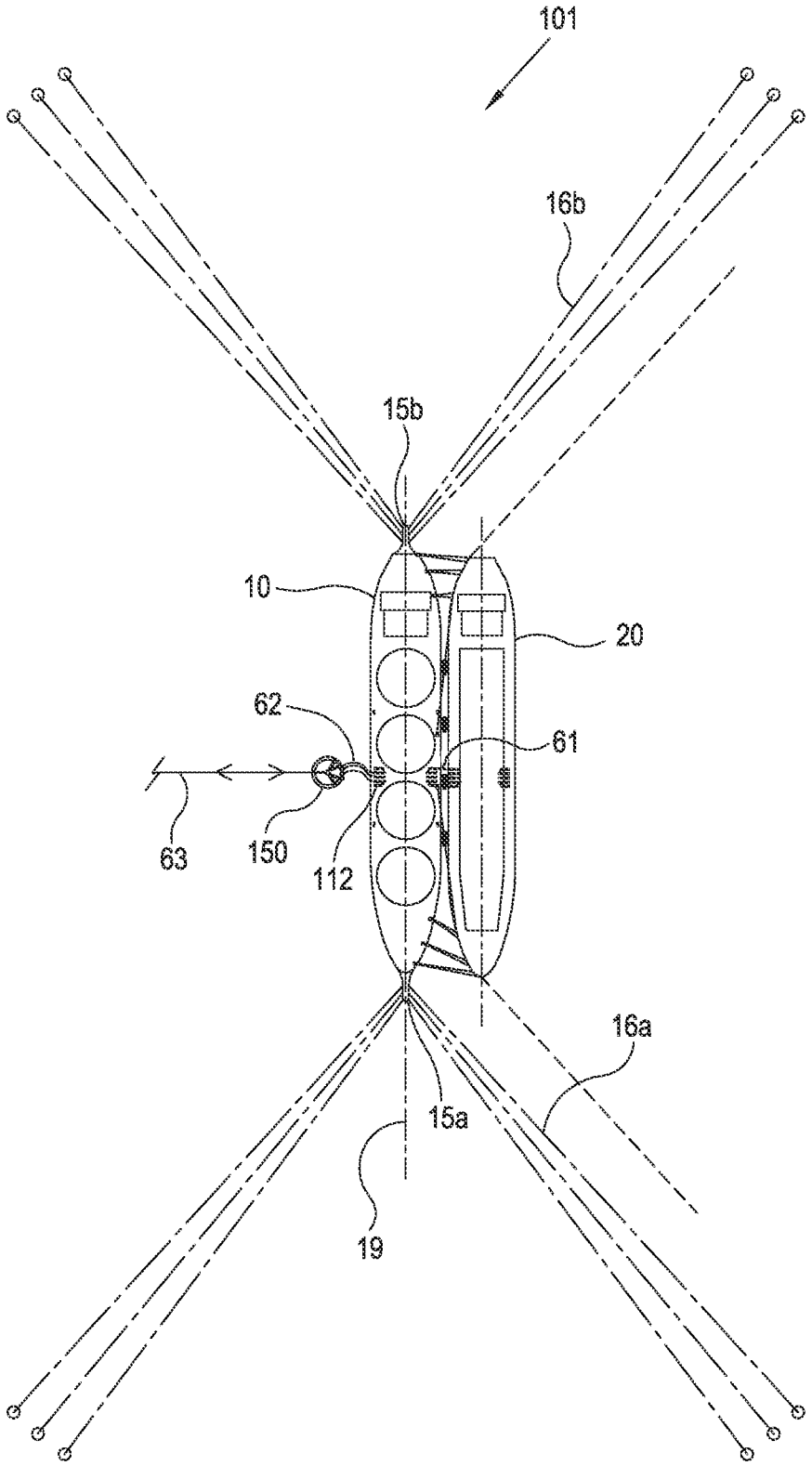
FIG. 3 is a plan-view representation of offshore terminal apparatus which includes a transfer tower, in accordance with another example.
Figure 4A:
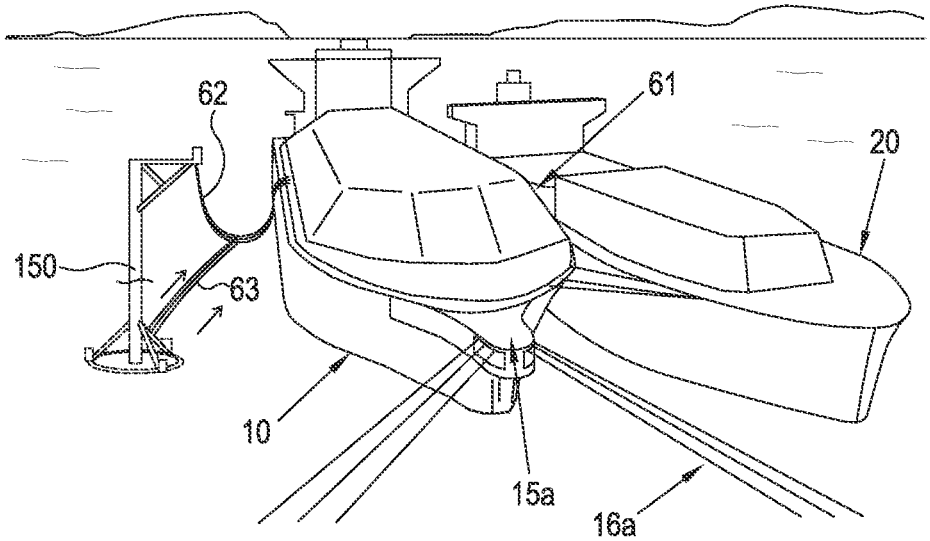
FIGS. 4A & 4B are front and rear perspective representations of the offshore terminal apparatus of FIG. 3.
Figure 4B:
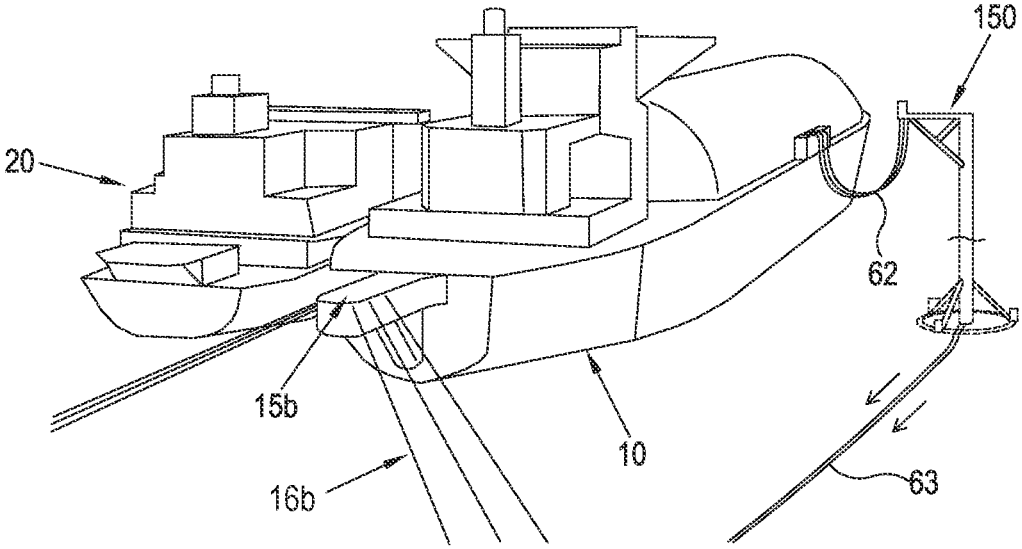

Turning now to FIGS. 3, 4A and 4B, offshore terminal apparatus 101 is a variant of the apparatus 1 described above, where instead of the jack-up platform, it includes a transfer tower 150. The transfer tower is supported on the seabed at the foot of the tower. The tower extends upward penetrating the sea surface and extending upward beyond the wave action zone to a height near the deck level or the level of the mid ship manifold 112. Aerial hoses 62 extend between the transfer tower 150 and the mid ship manifold 112 of the floating storage vessel 10 above the wave action zone minimizing the risk of damage to the hoses by wave forces during extreme wave conditions. The third tubing in the form of pipeline 63 extends along the seabed, typically from a foot or submerged portion of the tower. Fluid is transferred in use through the tower and the hoses 62 between the floating storage vessel 30 and the pipeline 63. The tower 150 has a conduit along the tower, e.g. passing from an upper end above the sea surface to a lower end below the sea to, for communicating fluid cargo between the hoses 62 and pipeline 63 during offloading or loading operations. In this example, liquefaction or regasification can take place onshore. Thus, the fluid cargo is transferred directly, without processing, through the transfer tower 150 to or from the floating storage vessel 10. In this case, to keep gas in liquid form, the pipeline may be insulated, e.g. be a pipe in pipe pipeline.

Figure 6:
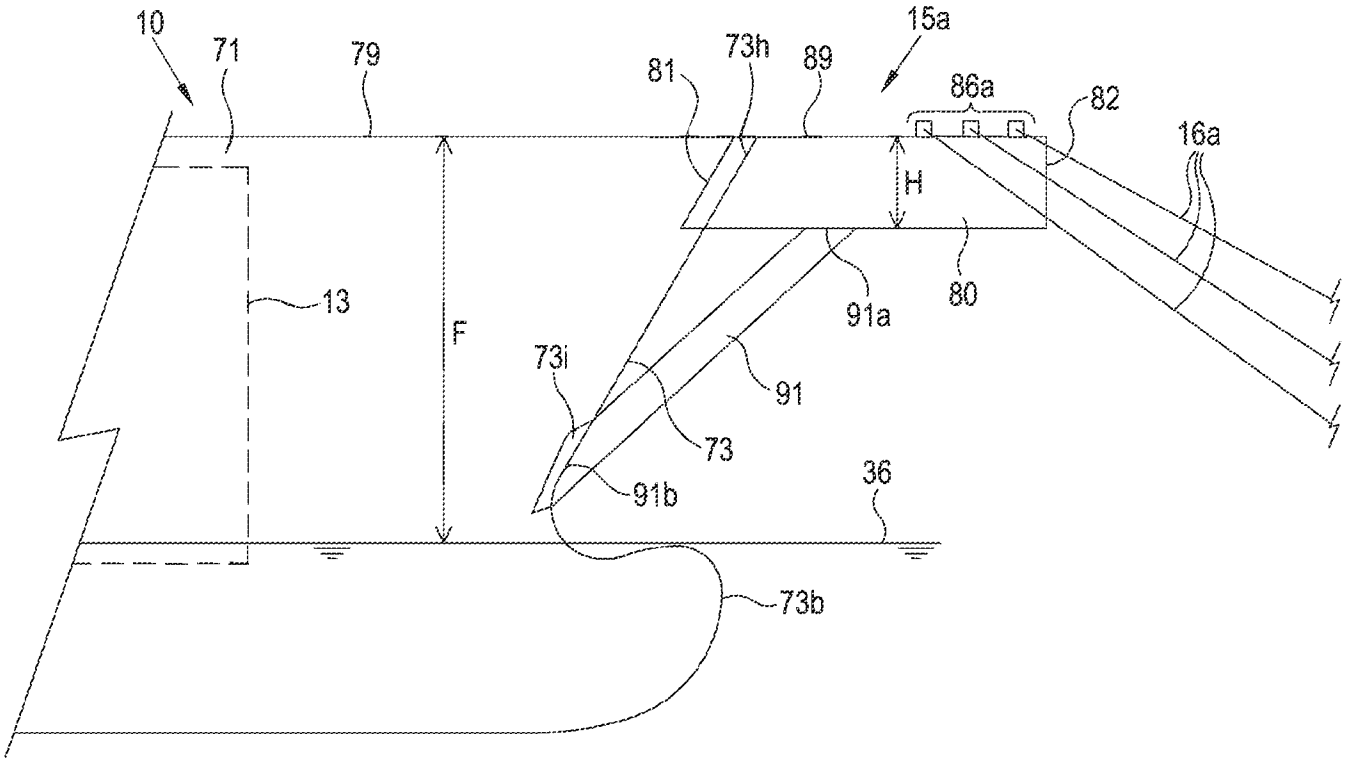
FIG. 6 is a larger scale schematic side view representation of a bow end portion of the floating storage vessel with an extension section fitted.

In FIG. 6, the bow end of the floating storage vessel 10 is depicted in further detail with the extension section 15*a* fitted to the bow end. In order to provide the floating storage vessel 10 with the extension section 15*a* as depicted in FIG. 6, a designated tanker ship to be adapted is provided comprising a hull 71 and one or more tanks 13 in the hull, and the extension sections 15*a*, 15*b* are then fitted to the hull 71 of the designated tanker. To facilitate with this, the extension section 15*a*, 15*b* comprises a box structure 80 which is prefabricated ready to be fitted to the tanker. It will be appreciated that the extension section 15*b* can be configured and connected at the stern end in corresponding manner to the extension section 15*a* described herein for the bow end. Thus, only the bow end configuration and the extension section 15*a* is described in detail in the following for purposes of brevity.

The box structure 80 is configured to fit the bow end 73 at a connecting location 73*h* on the bow end where it is welded to the bow end 73 of the hull 71. The one or more tanks 13 are provided in the hull 71 for storing fluid offloaded from or to be loaded onto the cargo vessel in use. The box structure 80 extends longitudinally away from the connecting location 73*h*. The box structure 80 may comprise a prismatic structure in other examples.

At an upper part of the hull 71, the hull has a hull deck 79 comprising walkways and/or areas for personnel or crew access. Other decks (not shown) may be provided as part of the superstructure upon the hull. The hull deck 79 may be equipped with handling equipment to be operated, accessed, and/or inspected by personnel onboard the vessel, the equipment including for example lifting and handling equipment, or mooring devices for facilitating in mooring the cargo vessel 20 alongside. Personnel standing on the hull deck 79 may also access the mid-ship manifold 12 for facilitating connection of one or more fluid cargo transfer hoses 61 for loading or offloading fluid cargo into the holds or tanks 13 in the hull. The hull 71 in an intermediate section between the stern and bow ends defines a maximum width of the hull 71. The width of the hull 71 from certain locations along the hull 71 typically tapers away from the full width of the intermediate section toward the bow end 73 and toward the stern end respectively.

The box structure 80 of the extension section 15*a* preferably comprises welded steel plates. The box structure 80 preferably has a height H less than the topsides height F of the hull 71 above the waterline 36, and preferably has a width less than the maximum width of the hull at the intermediate section, e.g. typically less than half the maximum width or less than a quarter of the maximum width of the hull at the intermediate section.

The box structure 80 extends from a first end 81 to a second end 82. The first end 81 of the box structure 80 is located against and welded to the bow end 73 at the connection location 73*h* to connect the box structure 80 to the hull 71. The box structure 80 is elongate and extends longitudinally from the first end 81 at the connection location 73*h* toward the second end 82 in the longitudinal direction of the hull. Thus, the box structure 80 provides a longitudinal extension from the hull at the bow end. The structure protrudes longitudinally toward the second end 82 from an outer surface of the bow end at the connection location 73*h*, the second end 82 distally disposed with respect to the first end 81.

The box structure 80 is further arranged to be welded to the connection location 73*h* on the bow end 73 at or near the top of the hull so that the box structure 80 is aligned with the hull deck 79. In this way, the hull 71 can support the box structure 80 with the coupling means 86*a* on the box structure for the spread mooring lines 16*a* located high up upon the hull yet benefit from the inherent strength of the hull 71 at or near the deck level of the hull, through the welding of the first end 81 to the bow end 73, so that necessary mooring loads can be handled.

The extension section 15*a* also includes an extension section deck 89 on an upper portion of the box structure 80. When the extension section 15*a* is affixed to the hull 71 as seen in FIG. 6, the deck 89 of the extension section 15*a* is located at or near the same level as the hull deck 79. This arrangement can facilitate a strong and robust welded structural connection of the box structure 80 to the hull 71.

In the example of FIG. 6, the box structure 80 is additionally supported by a tubular bracing 91 member which extends from one end 91*a* connected to the box structure 80 at a location along the box structure 80 in the extension direction and to another end 91*b* connected to the bow end at a lower connection location 73*i*, which positioned lower than the connection location 73*h*, e.g. at or near the water line 36 such as at or near the bulbous member 73*b* of the bow end or in the case of the stern extension section 15*b* such as at or near the propeller location. In other examples however, the box structure 80 and welded end connection of the box structure 80 to the outer hull surface at the bow end alone may be sufficient, with the box structure 80 extending from the first end 81 at the connection location 73*h* toward its second end 82 longitudinally from the bow end of the hull. The box structure 80 (by only the connection of the first end 81 at 73*h*) is then sufficient to withstand the mooring loads imparted from the spread mooring lines 16*a* by forces imparted to the floating storage vessel 10 under prevailing met-ocean conditions.

The extension section 15*a* comprises typically a prefabricated welded steel plate structure 80 that can be fabricated at a yard in due time before the tanker ship arrives the yard. The coupling means 86*a* for the mooring chains will typically be installed on the prefabricated extension section 15*a* before the ship arrives so everything is ready when the ship arrives the yard. In this way, the extension section 15*a* can be "added onto" the ship, i.e. welded on, quickly and the ship can stay at a limited time at the yard.

In practice, the box structure 80 or other welded plate structure for example has a height of 5 m or more. The length of the extension section 15*a* may be determined from project to project depending upon the size of the cargo vessels 20 planned to be moored in a side-by-side mooring arrangement to the floating storage vessel 10.

The coupling means 86*a* are fitted to the extension section 15*a* for coupling the mooring lines 16*a*, typically in the form of mooring chains, to the extension section 15*a*. There are typically 6-10 chains per extension section where each chain can be connected to an individual coupling means 16*a*, although six mooring lines per extension section are illustrated in the drawings. The coupling means 86*a* in certain examples are of "adjustable type", so that after the chain has been pulled in, chain tension can be adjusted by pulling in more of the chain or slackening out the chain by use of the adjustable coupling means. The adjustable means is for example used after the vessel 10 has been in operation for some time to re-tension the mooring lines 16*a*, if needed. In some examples, the coupling means 86*a* is equipped with a load monitoring device to monitor the mooring chain loads continuously during operation. This can ensure that the mooring tension is evenly distributed between all the chains. Load monitoring can be particularly beneficial during operations in inclement weather to make sure that the mooring tension is within acceptable level. In some examples, the coupling means 86*a* are of releasable type, that is the coupling means 86*a* have release mechanisms so that the mooring lines 16*a* can be released from the extension section 15*a* if the vessel 10 must leave location (e.g., during exceptionally bad weather). Such release mechanisms can be remotely operated for instance by hydraulics or other means. The coupling means 86*a* are supported on the deck 89 of the extension section 15*a*, typically at or near the extension deck level. The coupling means 86*a* on the extension section 15*a* are sufficient and carry the coupling means necessary for the bow end coupling of the spread-mooring lines 16*a* to the vessel without requiring any coupling of mooring lines 16*a* to the hull between the extension sections. The same applies correspondingly to the stern with use of the extension section 15*b*. In this way, the mooring area for the cargo vessel 20 can be defined alongside the floating storage vessel 10 between the extension sections 15*a*, 15*b*.

Figure 5:
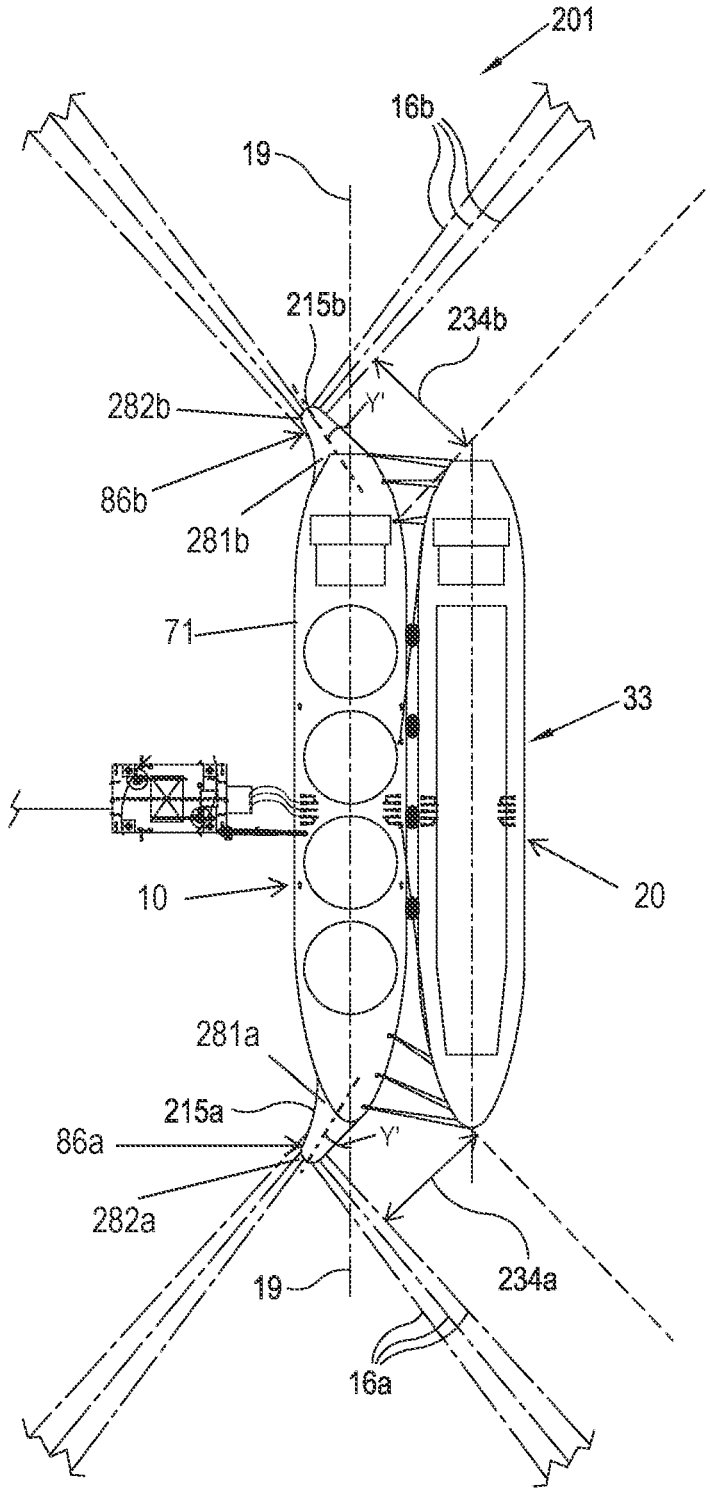
FIG. 5 is a plan-view representation of offshore terminal apparatus in which the floating storage is fitted with deviated extension sections respectively at the bow and stern ends to allow even larger safety gap between the vessels.

The offshore terminal apparatus 201 of FIG. 5 is similar to the apparatus 1 described above although the floating storage vessel 10 in this example is fitted with deviated extension sections 215*a*, 215*b* at the bow and stern ends 10*a*, 10*b*. That is, the points of departure of the spread-mooring lines 16*a*, 16*b* from the extension sections 215*a*, 215*b* are positioned away from the central longitudinal axis 19 of the hull 71. In particular, the extension section 215*a*, 215*b* in this example extends from a proximal, first end 281*a*, 281*b* which is connected, i.e. retrofit welded to the bow or stern of the vessel, toward a distal, second end 282*a*, 282*b* in a deviated direction extending at an angle Y, Y' from the central longitudinal axis of the hull 71. The extension section 215*a* at the first end 281*a*, 281*b* is welded onto the bow or stern end of the vessel 10 to extend and protrude from an outer hull surface on the bow or stern end. The coupling means 86*a*, 86*b* provide departure points on the extension sections 215*a*, 215*a* for the mooring lines 16*a*, 216*b* toward the seabed mooring members. The deviated extension sections 215*a*, 215*b* are angled away from the longitudinal axis 19 and away from the side of the vessel 10 on which the mooring area 33 for the visiting cargo vessel 20 is provided. This can allow for a greater clearance or safety gap 234*a*, 234*b* between the spread mooring lines 16*a*, 16*b* and the cargo vessel 20 when moored in the mooring area 33. By varying the angle Y, Y' and the length of the deviated extension sections 215*a*, 215*b* between the first and second ends an optimized safety gap 234*a*, 234*b* can be obtained to fit the specific project requirements and size of the cargo vessels 20. The angle of deviation can be varied in different examples, according to requirements. The deviated extension section 215*a*, 215*b* can otherwise be configured in terms of structure and connection as described above in relation to any of the other extension sections described above.

The floating storage vessel can in any example described herein be a floating storage unit (FSU) and in particular examples the floating storage unit may be a floating storage and regasification unit (FSRU).

What is claimed is:

1. A floating storage vessel comprising a hull having bow and stern ends and which at either or both the bow and stern ends is an elongated extension section projecting horizontally away from an upper part of the hull, the extension section having at least two couplings spaced apart from one another on the extension section, each coupling engaging a separate spread mooring line.

2. The floating storage vessel as claimed in claim 1, wherein the hull comprises a hull deck, and the extension section is arranged to be aligned in elevation with the hull deck.

3. The floating storage vessel as claimed in claim 1, wherein the extension section comprises a box structure of welded plates and an extension deck on the box structure.

4. The floating storage vessel as claimed in claim 3, wherein the couplings are arranged on or accessible by personnel from the extension deck.

5. The floating storage vessel as claimed in claim 1, wherein the extension section comprises a box structure which extends from a first end to a second end in a horizontal direction, the first end of the box structure connecting to the hull at an upper location on the bow or stern end, wherein the box structure may be supported by at least one bracing member connecting to the box structure at a location between the first and second ends of the box structure, or at the second end of the box structure, and to the hull at a lower location on the bow or stern end, which is near a propeller location if disposed on the stern or near a bulb location if disposed on the bow.

6. The floating storage vessel as claimed in claim 1, wherein the extension section comprises a box structure comprising welded steel plates, wherein the box structure is elongate to extend between first and second ends, the extension section being welded at the first end to connect the box structure to the hull at the bow or stern end, said connection of the first end of the box structure being the only or the only required connection of the structure to the hull.

7. The floating storage vessel as claimed in claim 1, wherein the extension section at either or both the bow and stern ends has first and second ends, the first end of the extension section being connected to the hull at the bow or the stern end, and extending from the first end toward the second end in the longitudinal direction of the hull.

8. The floating storage vessel as claimed in claim 1, wherein the hull has a longitudinal axis, and the extension section at either or both the bow and stern ends is a deviated extension section, wherein the deviated extension section extends from first end, which is connected to the hull at the bow end or the stern end, toward the second end at an angle away from the longitudinal axis.

9. An offshore terminal apparatus comprising:

a floating storage vessel which is spread-moored in fixed heading orientation to a seabed offshore by spread mooring lines, the floating storage vessel comprising a hull extending along a longitudinal axis, the hull having bow and stern ends and which at either or both the bow end and the stern end an elongated extension section projects away from the hull so as to be parallel with the longitudinal axis, the extension section having at least four spaced apart couplings disposed along a portion of the length of the extension section, each coupling engaging a separate spread mooring line.

10. The offshore terminal apparatus as claimed in claim 9, further comprising a cargo vessel, the cargo vessel being moored to the floating storage vessel in side-by-side relationship for transferring fluid cargo between the floating storage vessel and the cargo vessel.

11. The offshore terminal apparatus as claimed in claim 10, wherein the cargo vessel is moored in a mooring area between the bow end and stern end spread mooring lines.

12. The offshore terminal apparatus as claimed in claim 10, wherein the floating storage vessel comprises bow and stern extension sections, and the cargo vessel is moored in a mooring area alongside the floating storage vessel between the extension sections, the couplings on the extension sections defining points of departure for the spread mooring lines, so that at least a predetermined distance or gap is maintained horizontally between the nearest spread mooring lines and the moored cargo vessel in the mooring area.

13. The offshore terminal apparatus as claimed in claim 10, wherein the cargo vessel is typically moored so that a mid-ship manifold of the cargo vessel is located opposite a mid-ship manifold of the floating storage vessel.

14. The offshore terminal apparatus as claimed in claim 10, further comprising first tubing for transferring fluid cargo between the floating storage vessel and the cargo vessel.

15. The offshore terminal apparatus as claimed in claim 10, further comprising a platform or a transfer tower supported upon the seabed, and second tubing for transferring fluid cargo between the floating storage vessel and the platform or the transfer tower structure.

16. The offshore terminal apparatus as claimed in claim 15, further comprising the platform and wherein the fluid cargo is liquefied gas, and a regasification facility on the platform for regasifying the liquefied gas.

17. The offshore terminal apparatus as claimed in claim 10, further comprising third tubing for communicating the fluid cargo between the platform or the transfer tower and shore.

18. The offshore terminal apparatus as claimed in claim 15, wherein the platform or transfer tower is arranged on an opposite side of the floating storage vessel to the cargo vessel.

19. An extension section for a floating storage vessel comprising a hull comprising one or more holds or tanks in the hull for storing fluid, the hull extending along a longitudinal axis between a bow end and a stern end, the extension section comprising:

an elongated structure which extends parallel with the longitudinal axis between a first end and a second end, the first end of the structure affixed to the stern end or the bow end of the hull with the second end being arranged distally from the stern or bow end;

a plurality of couplings spaced apart from one another along the structure for coupling spread mooring lines to the extension section.

20. The extension section as claimed in claim 19, wherein the structure comprises welded steel plates.

21. The extension section as claimed in claim 20, wherein the structure comprises or is an elongated box structure.

22. The extension section as claimed in claim 21, wherein the first end of the box structure is weldable to the bow or stern end of the hull to join the box structure to the hull, the box structure being configured to be sufficiently supported for operational use through only said join of the first end of the box structure to the hull.

23. The extension section as claimed in claim 19, wherein the structure further comprises a deck for crew or personnel access, and the plurality of couplings are disposed along the deck.

24. The extension section as claimed in claim 19, wherein the hull comprises a hull deck, and the structure is configured to be connected to the hull, the structure being aligned with the hull deck.

25. The extension section as claimed in claim 19, wherein the structure extends from the first end to the second end along curve or dog leg.

26. The extension section as claimed in claim 19, where the elongated structure has a first side and a second side extending between the first end and second end, wherein the plurality of couplings comprises at least three couplings longitudinally spaced apart from each other along each of the first and second sides.

27. An offshore fluid cargo handling facility comprising:

a marine platform for processing fluid cargo;

a floating storage vessel spread moored adjacent the marine platform via a plurality of spread mooring lines, the floating storage vessel comprising a hull extending along a longitudinal axis, the hull having a bow end and a stern end, with an elongated extension section projecting away from the hull at each of the bow and stern end so as to be parallel with the longitudinal axis, each extension section having a first elongated side and a second elongated side with at least three couplings spaced longitudinally apart from one another along each elongated side, wherein one of the plurality of spread mooring lines is attached to each coupling;

one or more aerial fluid cargo hoses extending between the marine platform and the floating storage vessel;

a fluid cargo vessel having a bow end and a stern end and moored to the floating storage vessel so that the bow end and the stern end of the fluid cargo vessel are spaced apart from the spread mooring lines of the floating storage vessel.

28. The offshore fluid cargo handling facility of claim 27, wherein the fluid cargo vessel has a cargo vessel length defined between the bow end and the stern end of the fluid cargo vessel and the floating storage vessel has a storage vessel length defined between the bow end and the stern end of the floating storage vessel, wherein the cargo vessel length and the storage vessel length are approximately the same.

29. The offshore fluid cargo handling facility of claim 27, wherein the fluid cargo vessel has a cargo vessel length defined between the bow end and the stern end of the fluid cargo vessel and the floating storage vessel has a storage vessel length defined between the bow end and the stern end of the floating storage vessel, wherein the cargo vessel length is longer than the storage vessel length.

30. The offshore terminal apparatus as claimed in claim 9, wherein at both the bow end and the stern end an elongated extension section projects away from the hull so as to be parallel with the longitudinal axis, the extension section having at least four spaced apart couplings disposed along a portion of the length of the extension section, each coupling engaging a separate spread mooring lines.

* * * * *